US011657655B2

(12) United States Patent
Dudar et al.

(10) Patent No.: US 11,657,655 B2
(45) Date of Patent: May 23, 2023

(54) VEHICLE COMPONENT FAULT DETECTION

(71) Applicant: Ford Global Technologies, LLC, Dearborn, MI (US)

(72) Inventors: Aed M. Dudar, Canton, MI (US); Robert Roy Jentz, Westland, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 176 days.

(21) Appl. No.: 17/097,506

(22) Filed: Nov. 13, 2020

(65) Prior Publication Data

US 2022/0157086 A1 May 19, 2022

(51) Int. Cl.
*G07C 5/00* (2006.01)
*G07C 5/08* (2006.01)

(52) U.S. Cl.
CPC ..... *G07C 5/006* (2013.01); *G07C 5/0808* (2013.01)

(58) Field of Classification Search
CPC ..... G07C 5/006; G07C 5/0808
See application file for complete search history.

(56) References Cited

U.S. PATENT DOCUMENTS

| | | | | |
|---|---|---|---|---|
| 7,026,957 | B2 | 4/2006 | Rubenstein | |
| 7,085,680 | B2 | 8/2006 | Huang | |
| 8,862,314 | B2 | 10/2014 | Schmidt | |
| 9,128,625 | B1 * | 9/2015 | Ananthabhotla | G06F 9/4406 |
| 9,520,006 | B1 | 12/2016 | Sankovsky et al. | |
| 10,102,174 | B2 * | 10/2018 | Berkobin | G07C 5/0808 |
| 2007/0194889 | A1 * | 8/2007 | Bailey | H04L 9/321 340/10.51 |
| 2019/0228596 | A1 | 7/2019 | Mondello et al. | |

FOREIGN PATENT DOCUMENTS

| | | | | |
|---|---|---|---|---|
| WO | WO-0230148 | A1 * | 4/2002 | H04L 49/309 |
| WO | WO-0230149 | A1 * | 4/2002 | H04Q 11/0478 |
| WO | WO-2005048557 | A1 * | 5/2005 | H04L 29/06 |
| WO | WO-2005062808 | A2 * | 7/2005 | H04W 52/0225 |
| WO | WO-2005066914 | A1 * | 7/2005 | H04W 52/0225 |
| WO | WO-2005112301 | A2 * | 11/2005 | H04L 47/10 |

* cited by examiner

*Primary Examiner* — Joseph J Dallo
(74) *Attorney, Agent, or Firm* — Brandon Hicks; Bejin Bieneman PLC

(57) ABSTRACT

A computer includes a processor and a memory storing instructions executable by the processor to receive one or more parameters of a vehicle condition to be monitored, allocate an unreserved parameter identifier to each of the parameters, assign respective memory spaces to each of the allocated unreserved parameter identifiers, and store the parameters in the memory spaces.

20 Claims, 6 Drawing Sheets

VEHICLE COMPONENT FAULT DETECTION

BACKGROUND

A vehicle computer can monitor vehicle operation by collecting data from a variety of components. The data can be stored in dedicated memory space of vehicle components, typically in a dedicated, reserved memory space of an electronic control unit (ECU) or the like. Limited memory space in vehicle component storage, e.g., memory included in an ECU, can limit the amount and types of data collected by the computer. For example, vehicles are typically provided with OBD-II (On-Board Diagnostics) for reporting data and/or diagnosing fault conditions in the vehicle. OBD-II Parameter IDs (PIDs), also known as Diagnostic IDs (DIDs) are codes, i.e., identifiers, for data that can be requested from a vehicle via an OBD-II port in the vehicle. PIDs provide access to data stored in a memory, e.g., of an ECU. A device such as an ECU provided memory for a limited number of PIDs, i.e., for a limited number of data identified by respective PIDs.

DETAILED DESCRIPTION

Figure 1:
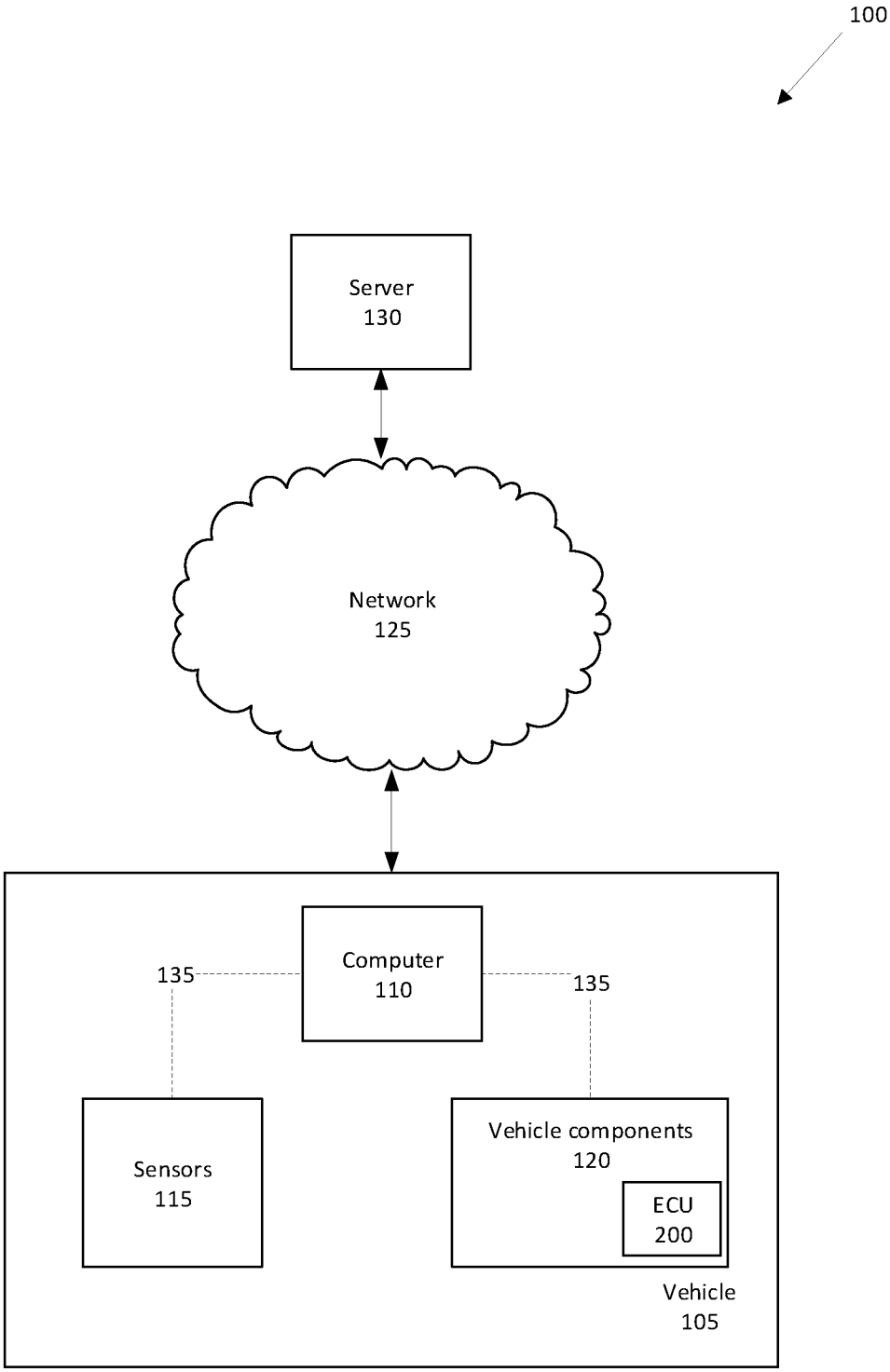
FIG. 1 is a block diagram of an example vehicle reporting and diagnostic system.

A system includes a computer including a processor and a memory, the memory storing instructions executable by the processor to receive one or more parameters of a vehicle condition to be monitored allocate an unreserved parameter identifier to each of the parameters, assign respective memory spaces to each of the allocated unreserved parameter identifiers, and store the parameters in the memory spaces.

The instructions can include instructions to retrieve the parameters to perform a diagnostic test.

The instructions can further include instructions to identify a fault of the vehicle component based on output of the diagnostic test.

The computer can be in a vehicle, and the instructions can further include instructions to send a message to a second vehicle, the message including the one or more parameters.

The instructions can further include instructions to receive the one or more parameters from an external server.

The instructions can further include instructions to send a message to an external server including the vehicle condition and the one or more parameters of the vehicle condition.

The instructions can further include instructions to allocate one of the unreserved parameter identifiers to an operation parameter of the vehicle component.

The operation parameter of the vehicle component can be one of the one or more parameters of the vehicle condition.

The instructions can further include instructions to unallocate the unreserved parameter identifiers from the one or more parameters of the vehicle condition and to reallocate the unreserved parameter identifiers to one or more parameters of a second vehicle condition.

The vehicle condition can indicate a fault in the vehicle component, and the fault can be one of an engine misfire, an exhaust gas recirculation flow blockage, a fuel tank evaporation subsystem leak, or a three-way catalyst degradation.

The parameters can include at least one of a pitch angle, a roll angle, or a yaw angle.

A system, comprising a computer including a processor and a memory, the memory storing instructions executable by the processor to store one or more parameters of a fault condition of a vehicle component in a plurality of memory spaces, each of the plurality of memory spaces storing data for one of the one or more parameters, retrieve data of one or more specified parameters to identify a fault of the vehicle component based on the fault condition, and overwrite at least one of the plurality of memory spaces upon identifying a second fault condition.

The instructions can further include instructions to store data of a parameter of the second fault condition in one of the overwritten memory spaces.

The instructions can further include instructions to retrieve the data of the parameter of the second fault condition to identify a second fault based on the second fault condition.

The computer can be in a vehicle, and the instructions can further include instructions to send a message to a second vehicle, the message including the one or more parameters of the fault condition.

The instructions can further include instructions to receive the one or more parameters of the fault condition from an external server.

The instructions can further include instructions to send a message to an external server including the fault, the fault condition, and the one or more parameters of the fault condition.

The instructions can further include instructions to assign one of the plurality of memory spaces to data of an operation parameter of the vehicle component.

The operation parameter of the vehicle component can be one of the one or more parameters of the fault condition and a parameter of the second fault condition.

The instructions can further include instructions to retrieve data of the operation parameter to identify a second fault based on the second fault condition.

A method includes receiving one or more parameters of a vehicle condition to be monitored allocate an unreserved parameter identifier to each of the parameters, assigning respective memory spaces to each of the allocated unreserved parameter identifiers, and storing the parameters in the memory spaces.

The method can further include retrieving the parameters to perform a diagnostic test.

The method can further include identifying a fault of the vehicle component based on output of the diagnostic test.

The method can further include sending a message to a vehicle, the message including the one or more parameters.

The method can further include receiving the one or more parameters from an external server.

The method can further include sending a message to an external server including the vehicle condition and the one or more parameters of the vehicle condition.

The method can further include allocating one of the unreserved parameter identifiers to an operation parameter of the vehicle component.

The method can further include unallocating the unreserved parameter identifiers from the one or more parameters of the vehicle condition and reallocating the unreserved parameter identifiers to one or more parameters of a second vehicle condition.

Further disclosed is a computing device programmed to execute any of the above method steps. Yet further disclosed is a vehicle comprising the computing device. Yet further disclosed is a computer program product, comprising a computer readable medium storing instructions executable by a computer processor, to execute any of the above method steps.

Reserving memory spaces for dynamically identified categories of data allows a vehicle electronic control unit (ECU) or the like to provide data otherwise not stored during operation of a vehicle. For example, a fault condition, e.g., indicated by a Diagnostic Trouble Code (DTC) or the like, can be detected, but, due to storage limitations, one or more parameters (i.e., specific types of data available from a vehicle component and/or via a vehicle network) relevant to diagnosing or determining (i.e., analyzing) a cause or causes of the fault condition may not have been stored. Reserving memory space for each parameter useful to diagnose fault conditions would require more space than is available in the ECU. Thus, to improve memory allocation in the ECU, a specified set of memory spaces and parameter identifiers can be allocated for parameters that are associated to fault conditions but not already reserved in the memory. Then, when different fault conditions are detected, these unreserved memory spaces and parameter identifiers can be accessed to store data for dynamically assigned parameters. Thus, data that otherwise would not be available for analyzing a fault condition can be provided, and memory of a device such as an ECU is used more efficiently and effectively than otherwise possible.

FIG. 1 illustrates an example vehicle reporting and diagnostic system. A computer 110 in a vehicle 105 is programmed to receive collected data from one or more sensors 115 and/or vehicle components, such as ECUs 200. The computer 110 can be a telematics control unit (TCU) or an electronic control unit gateway (ECG). That is, the computer 110 communicates with one or more ECUs 200 to collect and transmit data over a vehicle network 125. For example, the computer 110 can receive data from the vehicle network 125 from the ECUs 200, the data including, e.g., an engine coolant temperature, an ambient air temperature, an ambient air pressure, a steering wheel angle, a vehicle pitch angle, a vehicle roll angle, a vehicle yaw angle, a vehicle speed, an intake manifold vacuum, an engine speed, etc. Thus, the computer 110 can manage, store, and transmit data to be monitored between the ECUs 200 for diagnostic tests.

The computer 110 is generally programmed for communications on a vehicle network 135, e.g., including a conventional vehicle 105 communications bus such as a CAN bus, LIN bus, etc., and or other wired and/or wireless technologies, e.g., Ethernet, WIFI, etc. Via the network, bus, and/or other wired or wireless mechanisms (e.g., a wired or wireless local area network in the vehicle 105), the computer 110 may transmit messages to various devices in a vehicle 105 and/or receive messages from the various devices, e.g., controllers, actuators, sensors, etc., including sensors. Alternatively or additionally, in cases where the computer 110 actually comprises multiple devices, the vehicle network 125 may be used for communications between devices represented as the computer 110 in this disclosure. For example, the computer 110 can be a generic computer with a processor and memory as described above and/or may include a dedicated electronic circuit including an ASIC that is manufactured for a particular operation, e.g., an ASIC for processing sensor 115 data and/or communicating the sensor 115 data. In another example, computer 110 may include an FPGA (Field-Programmable Gate Array) which is an integrated circuit manufactured to be configurable by a user. Typically, a hardware description language such as VHDL (Very High Speed Integrated Circuit Hardware Description Language) is used in electronic design automation to describe digital and mixed-signal systems such as FPGA and ASIC. For example, an ASIC is manufactured based on VHDL programming provided pre-manufacturing, whereas logical components inside an FPGA may be configured based on VHDL programming, e.g. stored in a memory electrically connected to the FPGA circuit. In some examples, a combination of processor(s), ASIC(s), and/or FPGA circuits may be included in computer.

In addition, the computer 110 may be programmed for communicating with the network 125, which, as described below, may include various wired and/or wireless networking technologies, e.g., cellular, Bluetooth®, Bluetooth® Low Energy (BLE), wired and/or wireless packet networks, etc.

The memory can be of any type, e.g., hard disk drives, solid state drives, servers, or any volatile or non-volatile media. The memory can store the collected data sent from the sensors. The memory can be a separate device from the computer 110, and the computer 110 can retrieve information stored by the memory via a network in the vehicle 105, e.g., over a CAN bus, a wireless network, etc. Alternatively or additionally, the memory can be part of the computer 110, e.g., as a memory of the computer.

Sensors can include a variety of devices. For example, various controllers in a vehicle 105 may operate as sensors to provide data via the vehicle network 135 or bus, e.g., data relating to vehicle 105 speed, acceleration, location, subsystem and/or component 120 status, etc. Further, other sensors could include cameras, motion detectors, etc., i.e., sensors to provide data for evaluating a position of a component 120, evaluating a slope of a roadway, etc. The sensors could, without limitation, also include short range radar, long range radar, LIDAR, and/or ultrasonic transducers.

Collected data can include a variety of data collected in a vehicle 105. Examples of collected data are provided above, and moreover, data are generally collected using one or more sensors, and may additionally include data calculated therefrom in the computer 110, and/or at the server 130. In general, collected data may include any data that may be gathered by the sensors and/or computed from such data.

The vehicle 105 includes a plurality of vehicle components 120. In this context, each vehicle component 120 includes one or more hardware components 120 adapted to perform a mechanical function or operation—such as moving the vehicle 105, slowing or stopping the vehicle 105, steering the vehicle 105, etc. Non-limiting examples of components 120 include a propulsion component 120 (that includes, e.g., an internal combustion engine and/or an electric motor, etc.), a transmission component 120, a steering component 120 (e.g., that may include one or more of a steering wheel, a steering rack, etc.), a brake component 120, a park assist component 120, an adaptive cruise control component 120, an adaptive steering component 120, a movable seat, and the like. Components 120 can include computing devices, e.g., electronic control units (ECUs) 200 as described below or the like and/or computing devices such as described above with respect to the computer 110, and that likewise communicate via a vehicle 105 network.

The system 100 can further include a network 125 connected to a server 130. The computer 110 can further be programmed to communicate with one or more remote sites such as the server 130, via the network 125, such remote site possibly including a processor 205 and a memory 210. The network 125 represents one or more mechanisms by which a vehicle 105 computer 110 may communicate with a remote server 130. Accordingly, the network 125 can be one or more of various wired or wireless communication mechanisms, including any desired combination of wired (e.g., cable and fiber) and/or wireless (e.g., cellular, wireless, satellite, microwave, and radio frequency) communication mechanisms and any desired network 125 topology (or topologies when multiple communication mechanisms are utilized). Exemplary communication networks include wireless communication networks (e.g., using Bluetooth®, Bluetooth® Low Energy (BLE), IEEE 802.11, vehicle-to-vehicle (V2V) such as Dedicated Short Range Communications (DSRC), etc.), local area networks (LAN) and/or wide area networks (WAN), including the Internet, providing data communication services.

Figure 2:
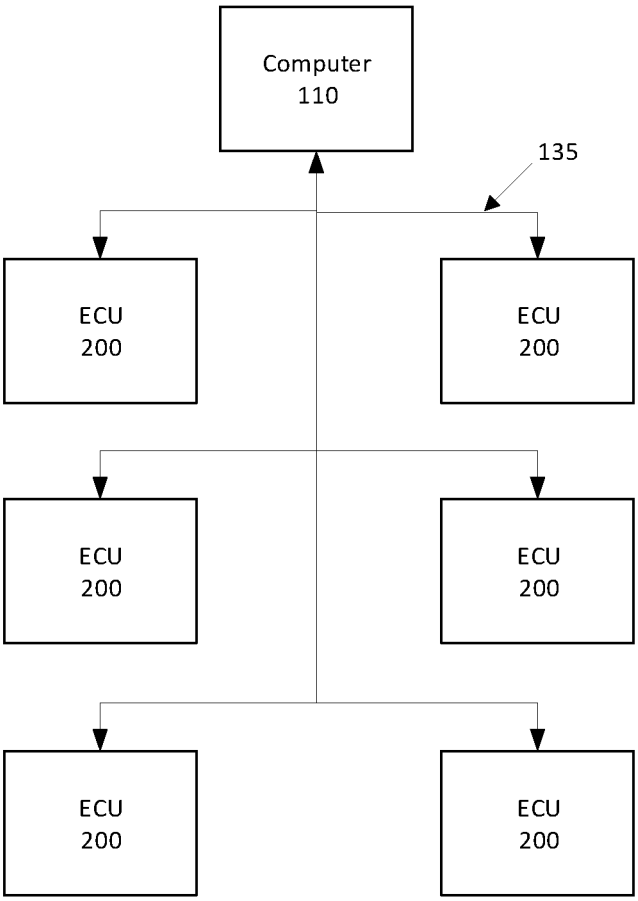
FIG. 2 is a block diagram of a computer of the example vehicle reporting and diagnostic system communicating with a plurality of electronic control units.

FIG. 2 is a block diagram of the computer 110 communicating with a plurality of ECUs 200. The computer 110 and the ECUs 200 communicate data over a vehicle network 135, e.g., a CAN bus. Each ECU 200 may be placed in, on, or proximate to one of the vehicle components 120. Each ECU 200 can collect and store data about the components 120. For example, the ECUs 200 can collect and store operation data of the components 120, e.g., a speed at which a propulsion rotates, a steering wheel angle, a brake pressure, etc. The ECUs 200 can transmit the data over the vehicle network 135 to the computer 110. The computer 110 can thus manage data collected by the ECUs 200 to address fault conditions. Example ECUs 200 include conventional ECUs such as a Door Control Unit, Engine Control Unit, Electric Power Steering Control Unit, A Human-Machine Interface (HMI), Powertrain Control Module, Seat Control Unit, Speed Control Unit, Telematic Control Unit, Transmission Control Unit, Brake Control Module, and Battery Management System. Note that the Telematics Control Unit (TCU) or Electronic Control Unit Gateway (ECG) are included in the definition of the computer 110 above, but can also be ECUs 200; that is, a telematics control unit or electronic control unit gateway can be configured, e.g., programmed, to carry out operations ascribed herein to the computer 110, as well as performing operations ascribed to the respective ECU 200.

Figure 3:
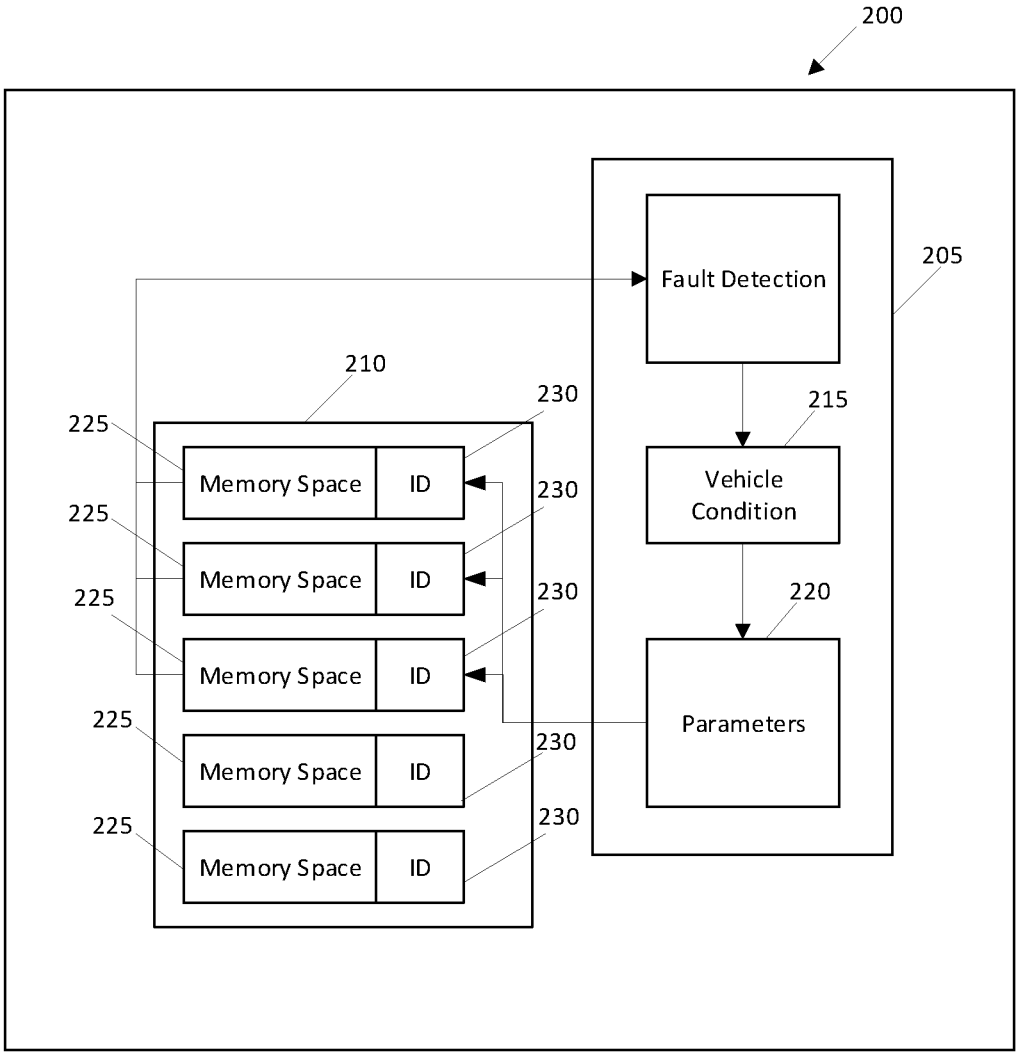
FIG. 3 is a diagram of one of the electronic control units including data storage.

FIG. 3 is a block diagram of an electronic control unit (ECU) 200 of a vehicle component 120. As described above, each vehicle component 120 can include one or more ECUs 200 that collect and store data and instruct one or more hardware parts of the vehicle component 120 to perform a mechanical function based on the collected and stored data. As described above, the ECUs 200 can communicate with the computer 110 via a vehicle network 135, e.g., a CAN bus. The ECU 200 includes a processor 205 and a memory 210. As described above, the memory 210 can store instructions executable by the processor 205.

The processor 205 can receive a vehicle condition 215 of a vehicle component 120. In this context, a "vehicle condition" is a condition of a vehicle component 120 that should be monitored that can impair operation and/or gives rise to repair and/or maintenance needs. A vehicle condition 215 can include a defect or degradation of the vehicle component 120. That is, the vehicle condition 215 can be a fault condition, i.e., a vehicle condition 215 that may result in a fault of the vehicle component 120. A "fault" is a detection that the component 120 is not operating within one or more specified limits. Example faults include, e.g., an engine misfire, an exhaust gas recirculation flow blockage, a fuel tank evaporation subsystem leak, a three-way catalyst degradation, etc. The processor 205 can receive the vehicle condition 215 from the computer 110. The computer 110 can identify the vehicle condition 215 based on, e g, manual input from a user, a message from a central server 130, a diagnostic code as described below, etc. Alternatively or additionally, the processor 205 can identify the vehicle condition 215, e.g., upon receiving input from a user, receiving input from the central server 130, receiving the diagnostic code, etc.

A vehicle condition 215 can be determined according to a Diagnostic Trouble Code (DTC) but further can be determined even if a fault and/or severity level is not indicated by a conventional diagnostic code, e.g., a DTC as described below. Example diagnostic codes (also referred to as fault codes or trouble codes) include Diagnostic Trouble Codes (DTCs) or OBD-II Trouble Codes and the like. In general, diagnostic codes are codes that an electronic control unit may generate and receive via the vehicle 105 communications network 125 such as a Controller Area Network 125 (CAN) communications bus. A diagnostic trouble code (DTC) is typically a unique numeric code specifying a vehicle condition 215 and can be associated with a vehicle condition 215, a diagnostic condition, a diagnostic status, etc. When the electronic control unit 200 detects a fault in a vehicle component 120, it can activate the corresponding diagnostic trouble code. A vehicle 105 stores the diagnostic trouble code in the memory 210 of the ECU 200 when it detects a component 120 that is not operating within specified limits. The diagnostic trouble code can help to identify the vehicle condition 215 for diagnosis and repair.

The processor 205 can identify the vehicle condition 215 based on a predicted failure rate of the vehicle component 120. A "failure rate" is a probability that the component 120 will undergo a specific fault. Because each fault can result in a vehicle condition 215, the processor 205 can predict the likelihood of a particular vehicle condition 215 based on a predicted probability that the component 120 will undergo a fault. For example, if the fault is a three-way catalyst degradation that is 1% likely to occur after 50,000 miles of operation, the processor 205 can identify the vehicle condition 215 as a DTC for catalyst efficiency when the vehicle 105 has traveled more than 50,000 miles.

The processor 205 can identify one or more parameters 220 to be monitored that are associated to the vehicle condition 215. A "parameter" is a data value, i.e., a measured quantity or state, that can be collected by one or more sensors 115. The parameters 220 are "associated to" the vehicle condition 215 when data of the parameters 220 can be used in a diagnostic test related to vehicle condition 215. That is, the parameters 220 are metrics that describe important characteristics about the vehicle condition 215. Example parameters 220 can include, e.g., a pitch angle, a roll angle, a yaw angle, oxygen level in a catalytic converter, air/fuel ratio in an exhaust pipe, fuel level in a fuel tank, air pressure in the fuel tank, etc. For example, a vehicle condition 215 for a fuel tank evaporation subsystem leak can include associated parameters 220 such as, e.g., air pressure in the fuel tank, ambient temperature of air external to the vehicle 105, current altitude of a location at which the vehicle 105 is located, a current vehicle 105 speed, etc.

The memory 210 can include a plurality of memory spaces 225. The memory spaces 225 are portions of the memory 210 that store the parameters 220. For example, the memory spaces 225 can be specified addresses in the memory 210 in which the processor 205 stores data about the parameters 220. Upon identifying the vehicle condition 215, the processor 205 can instruct one or more sensors to collect data about the parameters 220 and to store the data in the memory spaces 225. That is, each memory space 225 can store data for one of the parameters 220.

Each memory space 225 can include a respective parameter identifier 230. A "parameter identifier" is an alphanumeric string that uniquely identifies the memory space 225 from the other memory spaces 225 and can be dynamically assigned to a parameter 220 to be stored, typically temporarily, in the memory space 225. That is, when the processor 205 stores data of one of the parameters 220 in one of the memory spaces 225, the processor 205 can assign the parameter identifier 230 of the memory space 225 to the parameter 220. Then, when the processor 205 requests data about the parameter 220, the processor 205 can retrieve data stored in the memory space 225 assigned with the parameter identifier 230. Because the parameter identifiers 230 are not reserved for specific parameters 220, the parameter identifiers 230 are "unreserved" parameter identifiers 230 that the processor 205 can allocate to a specified parameter 220. That is, each parameter identifier 230 can identify a parameter 220 for a current vehicle condition 215 and a different parameter 220 for another vehicle condition 215.

The processor 205 can allocate one of the unreserved parameter identifiers 230 to an operation parameter 220 of the vehicle component 120. That is, one of the parameters 220 of the vehicle condition 215 can be a parameter 220 describing operation of the vehicle component 120. For example, if the vehicle component 120 is a steering subsystem, the parameter 220 of the vehicle component 120 can be a steering angle. Thus, the vehicle condition 215 can use data about operation of the vehicle component 120 to resolve the vehicle condition 215. By using data about operation of the vehicle component 120, the processor 205 can more readily resolve the vehicle condition 215 than without using the vehicle component 120 data.

The processor 205 can determine that the vehicle condition 215 has been resolved. To "resolve" the vehicle condition 215 means that the condition that initiated the vehicle condition 215 is no longer present. For example, the vehicle condition 215 may be resolved when parameter 220 data collected from the component 120 indicate that the component 120 is operating within specified limits. In another example, the vehicle condition 215 may be resolved when an output of a diagnostic test indicates that the component 120 is operating within the specified limits. In yet another example, the vehicle condition 215 may be resolved upon receiving a message from a vehicle 105 computer 110 and/or a server 130. In yet another example, the vehicle condition 215 can be resolved upon determining that a time elapsed from identifying the vehicle condition 215 exceeds a time threshold.

In another example, the vehicle condition 215 can be resolved when the processor 205 identifies the fault of the vehicle component 120 that initiated the vehicle condition 215. The processor 205 can retrieve the data about the parameters 220 to identify the fault. For example, the processor 205 can retrieve the data to perform a diagnostic test to detect the fault. A "diagnostic test" is a test that compares data about operation of the vehicle component 120 to a predetermined threshold, and when the data violate the threshold, the processor 205 can determine that a fault has occurred. For example, the processor 205 can perform a leak diagnostic test for a fuel tank by comparing a pressure of an evacuated fuel tank to a threshold pressure listed in the diagnostic test. The threshold pressure is based on empirical testing of reference fuel tanks that have predetermined leak sizes. When the detected pressure exceeds the threshold pressure, the processor 205 can determine that the fuel tank has a leak greater than a manufacturer-specified maximum, and the processor 205 can output a fault indicating that the fuel tank has a leak. The pressure data are thus a parameter 220 used to identify the fault, and the processor 205 can allocate one of the unreserved parameter identifiers 230 to the pressure and store the pressure data in the memory space 225 to which the parameter identifier 230 is assigned. Then, to perform the diagnostic test, the processor 205 can retrieve the data associated with the parameter identifier 230 when performing the diagnostic test. Upon identifying the fault, the processor 205 can resolve the vehicle condition 215.

The processor 205 can end storage of parameters 220 to the memory spaces 225 upon resolving the vehicle condition 215. That is, because the vehicle condition 215 has been resolved, the processor 205 can unallocate the unreserved parameter identifiers 230 allocated for the specified parameters 220. That is, by unallocating the unreserved parameter identifiers 230, the parameter identifiers 230 are available for a new parameter 220 of a new vehicle condition 215. After unallocating the unreserved parameter identifiers 230, the processor 205 can detect a second vehicle condition 215 and overwrite at least one of the plurality of memory spaces 225 with new parameters 220 of the second vehicle condition 215. Thus, the unreserved parameter identifiers 230 would then store data of a second parameter 220 of the second vehicle condition 215. The unreserved parameter identifiers 230 allow the processor 205 to store data for a plurality of parameters 220 of a first vehicle condition 215 and to allow those unreserved parameter identifiers 230 to store data of other parameters 220 for another vehicle condition 215 upon resolution of the first vehicle condition 215. Thus, space in the memory 210 is conserved because only data relevant to a current vehicle condition 215 is stored.

The processor 205 can receive the parameters 220 of the vehicle condition 215 from an external source. That is, the parameters 220 for each vehicle condition 215 can be determined and stored in a source external to the vehicle 105, and the processor 205 can request the parameters 220 for the vehicle condition 215 from the external source. For example, the external source can be a remote server 130 dedicated to storing parameters 220 of vehicle conditions 215, and the processor 205 can send a message to the remote server 130 requesting the parameters 220 of an identified vehicle condition 215. In another example, the external source can be a second vehicle 105, and the processor 205 can send a message to a computer 110 of the second vehicle 105 via V2V requesting the parameters 220 of an identified vehicle condition 215. Upon resolving the vehicle condition 215, the processor 205 can send a message to the server 130 and/or the second vehicle 105 including the fault, the vehicle condition 215, and the parameters 220 of the vehicle condition 215. By sharing vehicle conditions 215, faults, and parameters 220 among vehicles and servers, a fleet of vehicles can more readily resolve vehicle conditions 215 than a single vehicle 105 attempting to identify parameters 220 to resolve vehicle conditions 215 without data from external sources. That is, sharing data about vehicle conditions 215 and associated parameters 220 can improve operation of a plurality of vehicles 105 connected to each other and to one or more servers 130 via the network 125 by identifying common vehicle conditions 215 and parameters 220 to resolve the associated faults.

Figure 4A:
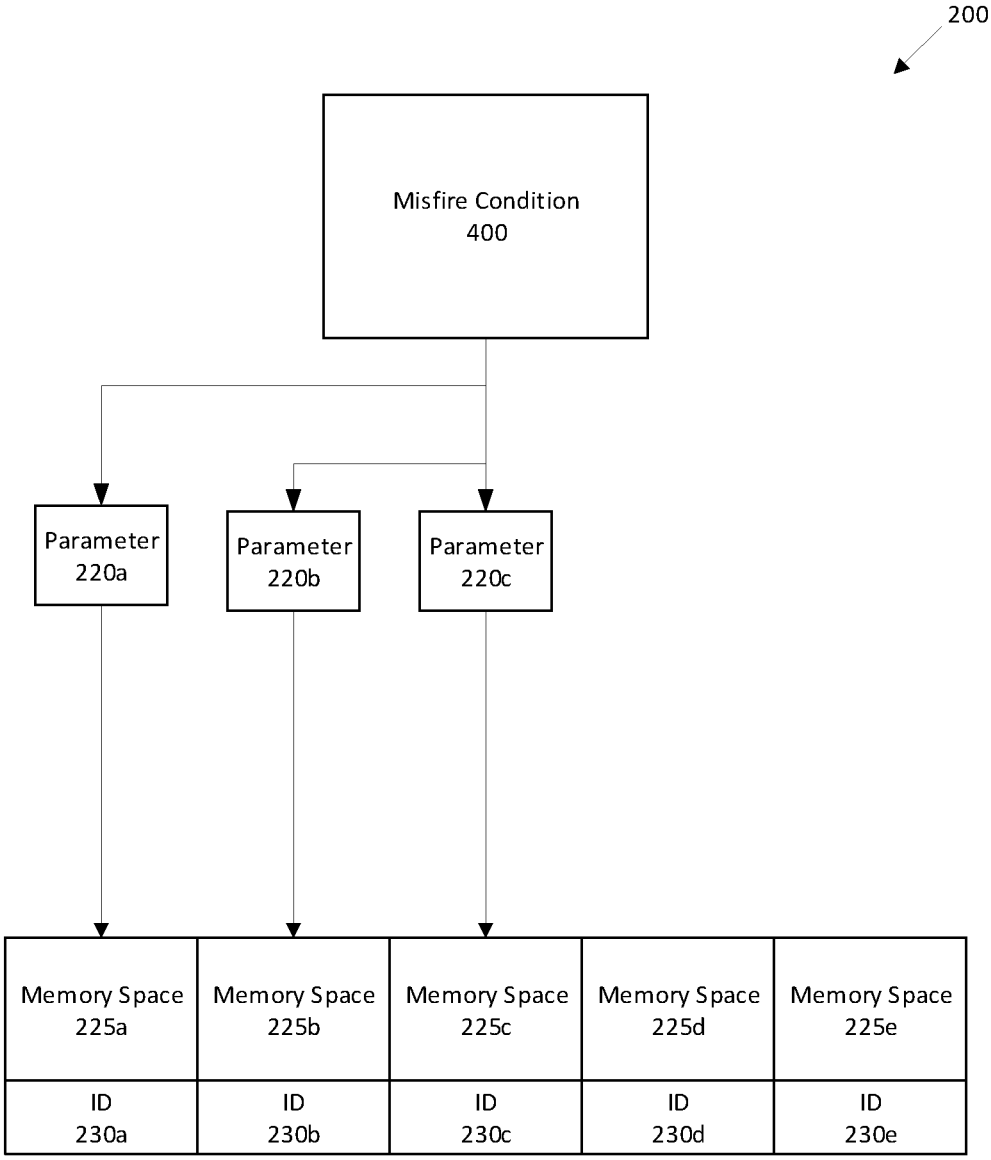
FIG. 4A is a diagram of data stored in the electronic control unit for a vehicle condition.
Figure 4B:
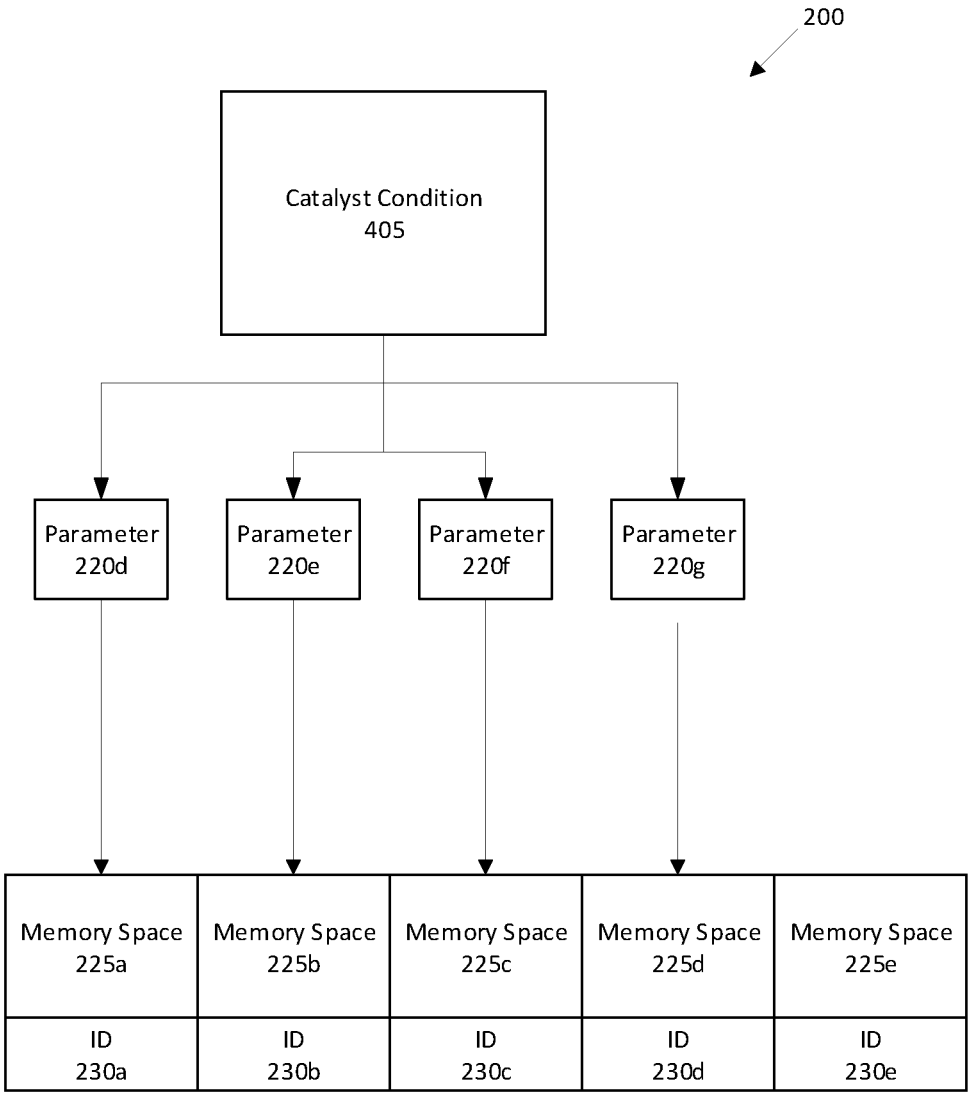
FIG. 4B is a diagram of data stored in the electronic control unit for another vehicle condition.

FIGS. 4A-4B are block diagrams of an ECU 200 that stores parameters 220 of example vehicle conditions 400, 405. FIG. 4A illustrates parameters 220*a*, 220*b*, 220*c* for an engine misfire condition 400. The misfire condition 400 indicates whether a propulsion has undergone a "misfire," i.e., an engine cycle without proper combustion of fuel in an engine cylinder. FIG. 4B illustrates parameters 220*d*, 220*e*, 220*f*, 220*g* of a catalyst condition 405. The catalyst condition 405 indicates whether a three-way catalytic converter (TWCC) properly converts nitric oxide and carbon monoxide emissions in exhaust to carbon dioxide and molecular nitrogen.

Parameters 220 may not be regularly stored in ECU 200 memory 210, e.g., memory spaces 225, due to limitations in an amount of memory available in an ECU 200. Advantageously, therefore, memory spaces 225 can be reserved for dynamic assignment of parameters 220. That is, when a vehicle condition 215 such as a misfire condition 400 or a catalyst condition 405 is identified, a vehicle computer 110 can execute programming, in response to user input or in response to identifying a specific vehicle condition 215 such as a misfire condition 400 or a catalyst condition 405, and/or in response to user input identifying specific parameters 220 to be stored, to identify parameters 220 to be stored and to instruct, typically via the vehicle network 135, the ECU 200 to store the parameters in its memory spaces 225. The selected (or identified) parameters 220 can then be stored in assigned memory spaces 225 for a specified period of time and/or until user input or ECU 200 programming specifies to release a memory space 225 for one or more parameters 220. For the engine misfire condition 400 of FIG. 4A, the processor 205 can assign the parameter 220*a* to the memory space 225*a* and the parameter identifier 230*a*, parameter 220*b* to memory space 225*b* and parameter identifier 230*b*, and parameter 220*c* to memory space 225*c* and parameter identifier 230*c*. The processor 205 can retrieve parameters 220*a*, 220*b*, 220*c* from the vehicle network 135 and store the parameters 220*a*, 220*b*, 220*c* in the memory spaces 225*a*, 225*b*, 225*c*.

In FIG. 4B, the processor 205 can receive the catalyst condition 405 and the parameters 220*d*, 220*e*, 220*f*, 220*g*. As described above, the ECU 200 in FIG. 4B has limited memory, five memory spaces 225*a*-225*e* in this example. Thus, assume that a misfire condition 400 has previously been determined, and that parameters 220 related to the misfire condition 400 are being stored in memory spaces 225*a*-225*e*. The processor 205 can dynamically unallocate one or more memory spaces 225*a*-225*e* from the parameters 220*a*-220*c* of the misfire condition 405 and then allocate the memory spaces 225*a*-225*e* to the parameters 220*d*-220*g*. As one example, the processor 205 can assign the parameter 220*d* to the memory space 225*a* and the parameter identifier 230*a*, overwriting the parameter 220*a* in the memory space 225*a*. Then, the processor 205 can retrieve the parameter 220*d* with the parameter identifier 230*a*. The processor 205 can allocate the parameter 220*e* to the memory space 225*b*, the parameter 220*f* to the memory space 225*c*, and the parameter 220*g* to the memory space 225*d*. The processor 205 can thus allocate the memory spaces 225*a*-225*e* to specific parameters 220*a*-220*g* that are associated to one of the vehicle conditions 400, 405 and to unallocated the memory spaces 225*a*-225*e* when the parameters 220*a*-220*g* are no longer needed. The dynamic allocation and reallocation of the memory spaces 225*a*-225*e* for each vehicle condition 400, 405 allows storage of the parameters 220*a*-220*g* only when needed, thus providing for efficient use of limited memory in the ECU 200.

Figure 5:
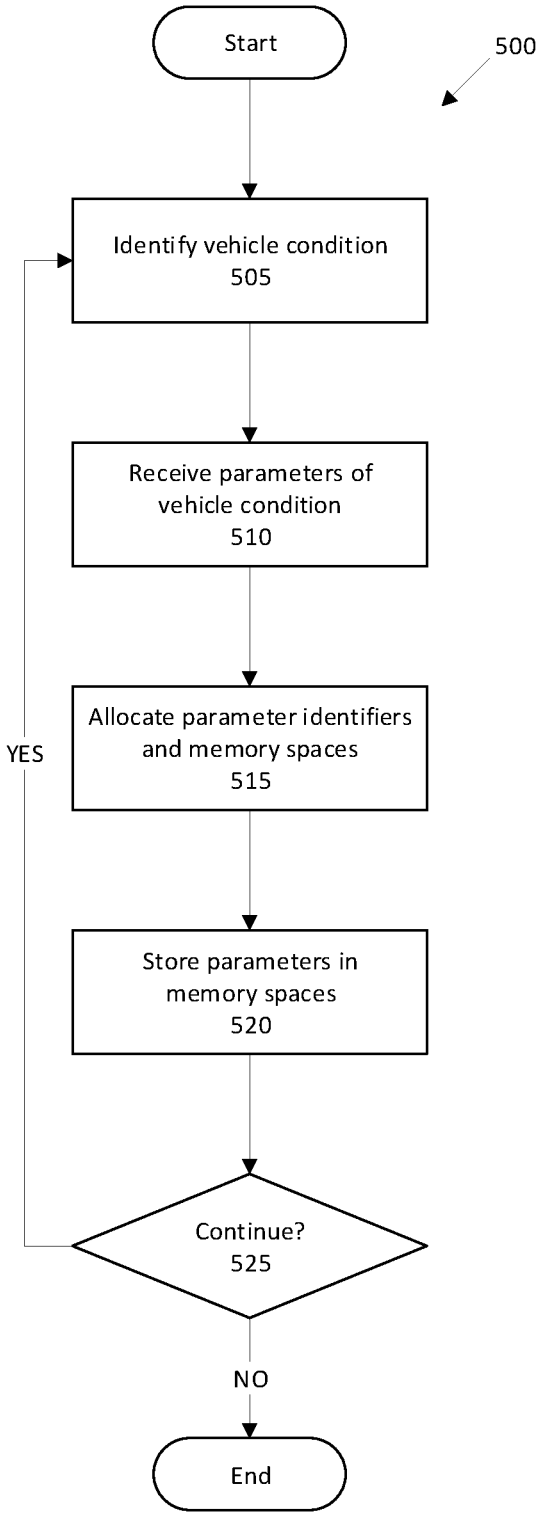
FIG. 5 is a block diagram of an example process for dynamically controlling component memory.

FIG. 5 is a diagram of an example process 500 for identifying and providing diagnostics in a vehicle 105. The process 500 begins in a block 505, in which a computer 110 identifies a vehicle condition 215. For example, a processor 205 of an ECU 200 could output the vehicle condition via vehicle network 135. As described above, the vehicle condition 215 is condition of a vehicle component 120 that should be monitored that can impair operation and/or gives rise to repair and/or maintenance needs. The vehicle condition 215 can be, e.g., a diagnostic trouble code (DTC) that indicates a potential fault in a component 120. Alternatively or additionally, the vehicle condition 215 can further be determined even if a fault and/or severity level is not indicated by a conventional diagnostic code, as described above. The computer 110 can identify the vehicle condition 215 based on, e.g., user input, a central server 130, another vehicle 105, etc.

Next, in a block 510, the processor 205 receives one or more parameters 220 of a vehicle condition 215, e.g., according to an instruction from the computer 110 or programming of the ECU 200. For example, the computer 110 can receive the parameters 220 to be stored from the server 130 and/or, upon identifying a vehicle condition 215, could consult a lookup table or the like specifying, for the vehicle condition and an ECU 200, parameters 220 to be stored in memory spaces 225 of the ECU 200, and possibly also specifying a duration, e.g., an amount of time, for which the parameters 220 are to be stored. As described above, parameters 220 of the vehicle condition 215 are measurable values about which an ECU 200 can collect data. For example, the vehicle condition 215 can be a fault condition, i.e., a condition of a vehicle component 120 that impairs operation and/or gives rise to repair and/or maintenance needs. The processor 205 can identify parameters to be monitored about the vehicle condition. For example, the ECU 200 can identify the vehicle condition 215 upon identifying a diagnostic trouble code (DTC) or the like. The processor 205 can receive the parameters 220 of the vehicle condition 215 from an external source, e.g., the computer 110, another vehicle 105, an external server 130, etc. For example, additionally or alternatively to the computer 110, the server 130 can store predetermined parameters 220 for each vehicle condition 215 and, when the computer 110 identifies the vehicle condition 215, the computer 110 can send a message to the server 130 requesting the parameters 220 for the identified vehicle condition 215. Upon receiving the parameters 220 from the server 130, the computer 110 can send a message to the processor 205 listing the parameters 220 received from the server 130.

Next, in a block 515, the processor 205 allocates a respective unreserved parameter identifier 230 and memory space 225 to each of the one or more parameters 220 identified for the identified vehicle condition 215. As described above, the unreserved parameter identifiers 230 and assigned memory spaces 225 can store data for parameters 220 of the vehicle condition 215. The parameter identifiers 230 and memory spaces 225 can be allocated for each vehicle condition 215. That is, the unreserved memory spaces 225, identified by respective generic parameter identifiers 230, can store data for respective dynamically identified parameters 220 based on a current vehicle condition.

Next, in a block 520, the processor 205 receives data, e.g., via ECU 200 sensors and/or via the vehicle network 135 and stores the parameters 220 in the memory spaces 225 assigned to respective parameter identifiers 230. As described above, the processor 205 can access the vehicle network 135 to retrieve the parameters 220 and store the parameters 220 in the memory spaces 225.

Next, in a block 525, the processor 205 determines whether to continue the process 300. The processor 205*c* an determine to continue the process 500 while the vehicle 105 continues to operate on a roadway. The processor 205*c* an determine not to continue the process 500 when the vehicle 105 is deactivated and powered off. If the processor 205 determines to continue, the process 500 returns to the block 505. Otherwise, the process 500 ends.

Computing devices discussed herein, including the computer 110 and the ECUs 200, include processors and memories, the memories generally each including instructions executable by one or more computing devices such as those identified above, and for carrying out blocks or steps of processes described above. Computer executable instructions may be compiled or interpreted from computer programs created using a variety of programming languages and/or technologies, including, without limitation, and either alone or in combination, Java™, C, C++, Visual Basic, Java Script, Python, Perl, HTML, etc. In general, a processor (e.g., a microprocessor) receives instructions, e.g., from a memory, a computer readable medium, etc., and executes these instructions, thereby performing one or more processes, including one or more of the processes described herein. Such instructions and other data may be stored and transmitted using a variety of computer readable media. A file in the computer 110 is generally a collection of data stored on a computer readable medium, such as a storage medium, a random access memory, etc.

A computer readable medium includes any medium that participates in providing data (e.g., instructions), which may be read by a computer. Such a medium may take many forms, including, but not limited to, non volatile media, volatile media, etc. Non volatile media include, for example, optical or magnetic disks and other persistent memory. Volatile media include dynamic random access memory (DRAM), which typically constitutes a main memory. Common forms of computer readable media include, for example, a floppy disk, a flexible disk, hard disk, magnetic tape, any other magnetic medium, a CD ROM, DVD, any other optical medium, punch cards, paper tape, any other physical medium with patterns of holes, a RAM, a PROM, an EPROM, a FLASH EEPROM, any other memory chip or cartridge, or any other medium from which a computer can read.

With regard to the media, processes, systems, methods, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. For example, in the process 500, one or more of the steps could be omitted, or the steps could be executed in a different order than shown in FIG. 5. In other words, the descriptions of systems and/or processes herein are provided for the purpose of illustrating certain embodiments and should in no way be construed so as to limit the disclosed subject matter.

Accordingly, it is to be understood that the present disclosure, including the above description and the accompanying figures and below claims, is intended to be illustrative and not restrictive. Many embodiments and applications other than the examples provided would be apparent to those of skill in the art upon reading the above description. The scope of the invention should be determined, not with reference to the above description, but should instead be determined with reference to claims appended hereto and/or included in a non-provisional patent application based hereon, along with the full scope of equivalents to which such claims are entitled. It is anticipated and intended that future developments will occur in the arts discussed herein, and that the disclosed systems and methods will be incorporated into such future embodiments. In sum, it should be understood that the disclosed subject matter is capable of modification and variation.

The article "a" modifying a noun should be understood as meaning one or more unless stated otherwise, or context requires otherwise. The phrase "based on" encompasses being partly or entirely based on.

The invention claimed is:

1. A system, comprising a computer including a processor and a memory, the memory storing instructions executable by the processor to:

receive one or more parameters of a vehicle condition to be monitored;

allocate an unreserved parameter identifier to each of the parameters;

assign respective memory spaces of one or more electronic control units of a vehicle to each of the allocated unreserved parameter identifiers; and store the parameters in the memory spaces.

2. The system of claim 1, wherein the instructions include instructions to retrieve the parameters to perform a diagnostic test.

3. The system of claim 2, wherein the instructions further include instructions to identify a fault of a vehicle component based on output of the diagnostic test.

4. The system of claim 1, wherein the computer is in a vehicle, and the instructions further include instructions to send a message to a second vehicle, the message including the one or more parameters.

5. The system of claim 1, wherein the instructions further include instructions to receive the one or more parameters from an external server.

6. The system of claim 1, wherein the instructions further include instructions to send a message to an external server including the vehicle condition and the one or more parameters of the vehicle condition.

7. The system of claim 1, wherein the instructions further include instructions to allocate one of the unreserved parameter identifiers to an operation parameter of a vehicle component.

8. The system of claim 7, wherein the operation parameter of the vehicle component is one of the one or more parameters of the vehicle condition.

9. The system of claim 1, wherein the instructions further include instructions to unallocate the unreserved parameter identifiers from the one or more parameters of the vehicle condition and to reallocate the unreserved parameter identifiers to one or more parameters of a second vehicle condition.

10. The system of claim 1, wherein the vehicle condition indicates a fault in the vehicle component, and the fault is one of an engine misfire, an exhaust gas recirculation flow blockage, a fuel tank evaporation subsystem leak, or a three-way catalyst degradation.

11. The system of claim 1, wherein the parameters include at least one of a pitch angle, a roll angle, or a yaw angle.

12. A system, comprising a computer including a processor and a memory, the memory storing instructions executable by the processor to:

store one or more parameters of a fault condition of a vehicle component in a plurality of memory spaces of one or more electronic control units of a vehicle, each of the plurality of memory spaces storing data for one of the one or more parameters based upon one or more allocated parameter identifiers;

retrieve data of one or more specified parameters to identify a fault of the vehicle component based on the fault condition;

reallocate the one of more allocated parameter identifiers to one or more second parameters of a second fault condition; and overwrite at least one of the plurality of memory spaces upon identifying the second fault condition.

13. The system of claim 12, wherein the instructions further include instructions to store data of a second parameter of the second fault condition in one of the overwritten memory spaces.

14. The system of claim 13, wherein the instructions further include instructions to retrieve the data of the second parameter of the second fault condition to identify a second fault based on the second fault condition.

15. The system of claim 12, wherein the computer is in a vehicle, and the instructions further include instructions to send a message to a second vehicle, the message including the one or more parameters of the fault condition.

16. The system of claim 12, wherein the instructions further include instructions to receive the one or more second parameters of the second fault condition from an external server.

17. The system of claim 12, wherein the instructions further include instructions to send a message to an external server including the fault, the fault condition, and the one or more parameters of the fault condition.

18. The system of claim 12, wherein the instructions further include instructions to assign one of the plurality of memory spaces to data of an operation parameter of the vehicle component.

19. The system of claim 18, wherein the operation parameter of the vehicle component is one of the one or more parameters of the fault condition and second parameters of the second fault condition.

20. The system of claim 19, wherein the instructions further include instructions to retrieve data of the operation parameter to identify a second fault based on the second fault condition.

* * * * *